United States Patent [19]

Lehmann

[11] Patent Number: 4,601,607

[45] Date of Patent: Jul. 22, 1986

[54] MINE SHAFT GUIDE SYSTEM

[75] Inventor: Richard P. Lehmann, Iron Mountain, Mich.

[73] Assignee: Lake Shore, Inc., Iron Mountain, Mich.

[21] Appl. No.: 702,910

[22] Filed: Feb. 19, 1985

[51] Int. Cl.[4] ..... E21D 1/00

[52] U.S. Cl. ..... 405/133; 188/67; 188/166; 188/110; 187/95; 187/88

[58] Field of Search ..... 405/133, 134; 285/333, 285/334; 187/95, 88; 188/67, 166, 110

[56] References Cited

U.S. PATENT DOCUMENTS

| | | | |
|---|---|---|---|
| 827,282 | 7/1906 | Anderson | 188/67 |
| 1,389,867 | 9/1921 | Griffin | 187/88 |
| 4,047,597 | 9/1977 | Okura et al. | 187/95 |
| 4,444,293 | 4/1984 | Paul et al. | 187/88 |
| 4,521,042 | 6/1985 | Blackburn et al. | 285/334 |

*Primary Examiner*—Cornelius J. Husar
*Assistant Examiner*—Kristina I. Hall
*Attorney, Agent, or Firm*—Bayard H. Michael

[57] ABSTRACT

The headframe supports tubular pipe guides in the shaft. Each guide comprises a multiplicity of pipes threaded one to another and extends below the normal range of conveyance travel in the shaft. Each guide is suspended from the headframe by a substantially solid bar depending from the headframe and threadably connected to the uppermost pipe. A bushing fixed in the shaft below the travel range has an associated pipe guide passing loosely therethrough to permit vertical and lateral movement of the pipe guide. A conveyance is suspended on wire rope from the headframe and is guided by the pipe guides. The conveyance has guide bushings slideably engaging each of the pipe guides. Weights are attached to the bottom of each of the pipe guides and the total weight added to each is not equal to that added to any other guide. This avoids having similar harmonics in the pipe guides. The weights are attached to a substantially solid bar threaded into the lower end of each of the pipe guides at a point spaced from the threaded connection between the guide and bar end. All of the threaded connections are pressure tight and the interior of each pipe guide is maintained at a pressure above atmospheric pressure. The pressure is monitored and a predetermined decrease in pressure activates an alarm. A safety mechanism is attached to the conveyance and includes a safety device operative to grip the pipe guide in response to a slack hoist rope.

6 Claims, 8 Drawing Figures

Fig. 6
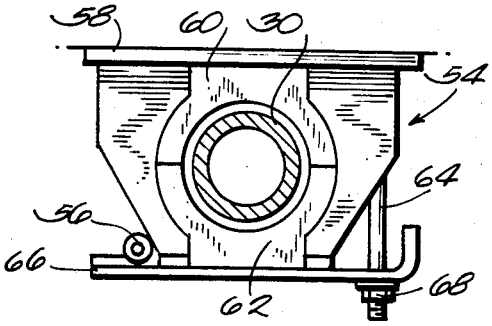
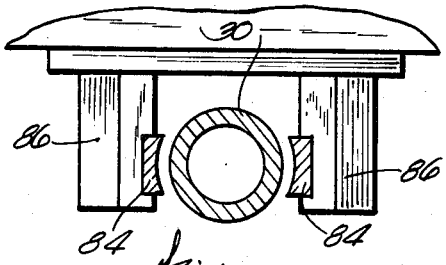
Fig. 7
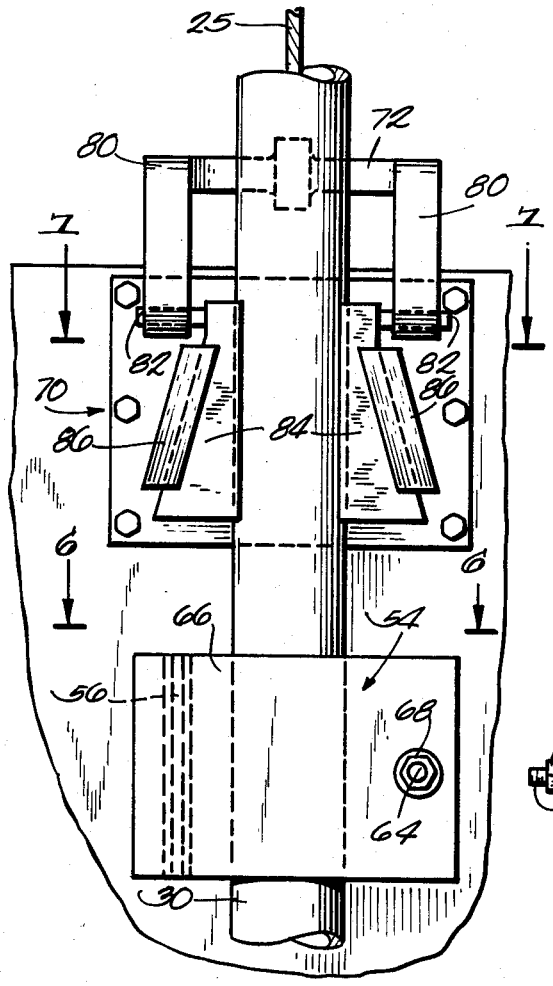
Fig. 5
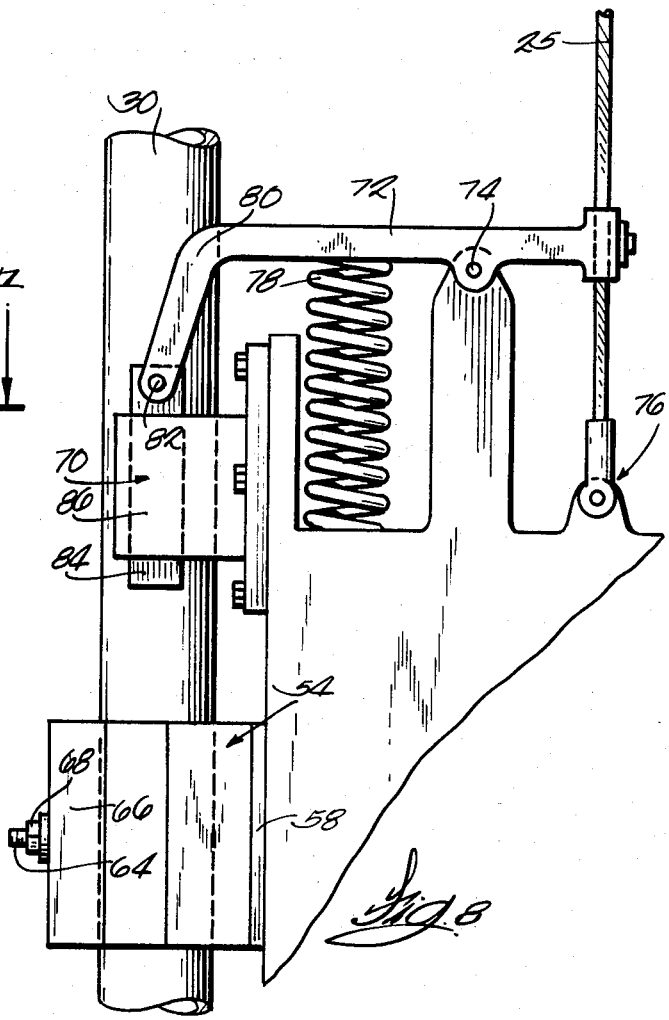
Fig. 8

MINE SHAFT GUIDE SYSTEM

BACKGROUND OF THE INVENTION

Underground mines utilize vertical shafts to provide access to underground workings. Conveyances (commonly called skips and cages) operate in the shaft and carry material and men. The conveyances run on guides which maintain proper orientation of the conveyance to the loading and unloading stations, keep the conveyances separated as they pass through the shaft and keep the conveyances from striking the shaft walls.

A typical guide system for the conveyances is referred to as a fixed or rigid guide system and utilizes wood timbers, rails, or structural tubing rigidly anchored to the shaft walls at intervals ranging from about 6 to 15 feet. More particularly, the guide timbers or rails are fixed to bunton sets (frames) fixed horizontally to the shaft wall. Mine shafts also supply ventilating air to the workings and the bunton sets resist air movement by causing turbulent airflow. This increases the power requirements for ventilating purposes.

Wire rope guide systems have been proposed to reduce the resistance to ventilating airflow and reduce the installation cost. The wire rope is a special type and is suspended from the headframe structure at the surface. The wire rope has great strength and rather small diameter which detracts from its utility since it provides a small surface for the guides on the conveyance.

Furthermore, if the conveyance is used for carrying men, it must be provided with a safety device to prevent free drop of the conveyance should the hoist cable break. The cable surface area is small and made up of many strands of wire. Therefore; actuation of the safety device (brake) can readily deform the rope and/or break strands and cause the rope to become unserviceable or fail totally. The wire rope simply can't take the extremely high crushing loads involved in setting the safety device.

In the past it has been proposed to use pipe for guide systems, but any such use has been limited to very short distances such as in buildings having only a few floors, etc. There are various reasons why pipe guide systems have not been used in deep shaft mines. The entire load of thousands of feet of pipe has to be carried by the threaded connections between the pipes. Ordinary pipe cannot stand this type of service. Past suspension systems resulted in stress concentrations at the headframe and this could cause failure of the suspension. It is difficult to inspect pipe guides. Ordinary pipe cannot safely be subjected to the crushing loads applied by a safety device in stopping the free fall of a 50 ton conveyance, for example.

With this as the background, the present invention proposes to use a suspended pipe guide system for deep mine shafts.

Using a pipe guide system which overcomes the objections to prior proposals will permit a lower cost installation and reduction in the cost of supplying ventilating air to the mine.

SUMMARY OF THE INVENTION

This invention provides a mine shaft having a headframe above the ground and a plurality of tubular pipe guides in the shaft. Each guide is made of a multiplicity of pipes threaded one to another to provide a smooth exterior surface at each threaded joint and extends below the normal range of conveyance travel in the shaft. Each guide is suspended from the headframe by a substantially solid bar depending from and threadably connected to the uppermost pipe. A bushing is fixed in the shaft below the normal travel range and the associated pipe guide passes loosely therethrough to permit vertical movement of the pipe guide relative to the bushing. A conveyance suspended on a cable from the headframe is guided by the pipe guides and the conveyance has guide bushings slideably engaging each of the pipe guides.

Another feature is to attach weights to the bottom of each of the pipe guides with the total weight added to each being unequal to that added to the other guides. This avoids setting up similar harmonics in the various pipe guides.

A further feature is that a substantially solid bar is threaded into the lower end of each of the pipe guides and the weights are attached to the bar at a point spaced from the threaded connection between the guide and the end of the bar.

Another feature is that all of the threaded connections are pressure tight and the interior of each pipe guide is maintained at a pressure above atmospheric pressure. The pressure is monitored and a predetermined decrease in pressure activates an alarm signal.

A safety mechanism is attached to the conveyance at each pipe guide and has safety dogs operative to clamp the guide in response to a slack hoist rope.

BRIEF DESCRIPTION OF THE DRAWINGS

FIG. 5 is an enlarged detail of the safety brake and guide brackets attached to each side at the top of the conveyance.

FIG. 6 is a horizontal section of FIG. 5 taken on line 6—6.

FIG. 7 is a horizontal section on line 7—7 in FIG. 5 through the safety brake arrangement.

FIG. 8 is a schematic showing of the safety brake arrangement from the side.

DETAILED DESCRIPTION OF THE DRAWINGS

Figure 2:
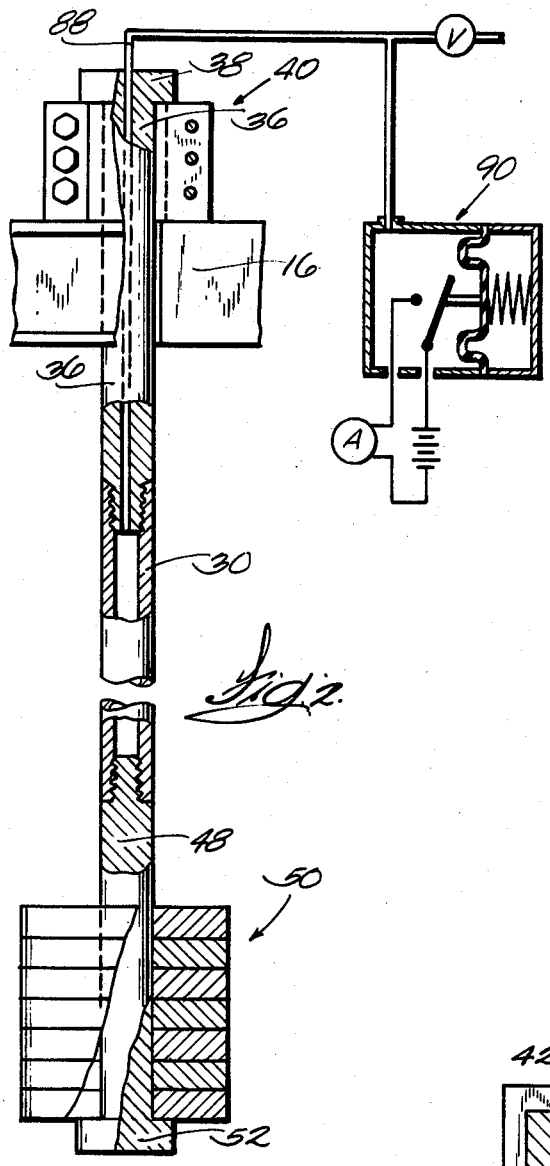
FIG. 2 shows the manner in which the pipe guide is suspended from the headframe deck and incorporates a schematic showing of the gas filled leak detection system.

A typical mine has a headframe 10 above the shaft 12. The headframe includes the upper and lower sheave decks 14, 16 on which the sheaves 18, 20 are respectively mounted with the hoist drum 22 being at ground level outside the brace truss 24. Wire rope 25 is reeved over the hoist drum and the sheaves 18, 20 to support conveyances 26, 28 in the shaft 12. Each conveyance is guided by guides 30, each of which is made up of a multiplicity of drill pipe sections threaded together. There can be two or four guides as appropriate.

Figure 3:
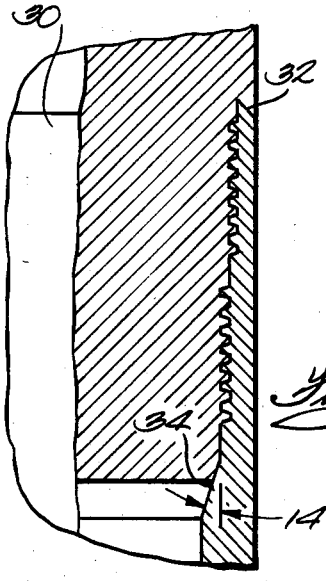
FIG. 3 is a detailed view on line 3—3 in FIG. 1 of a pipe joint showing the threading arrangement on two diameters.

The drill pipe is the same kind of high technology pipe as used in oil wells and provides threaded connections which provide a smooth exterior and also provide sealed joints which permit the interior to be pressurized. The lower end of each pipe section has male threading adapted to be received in a female thread on the next lower pipe section. The pipes are threaded on two diameters as can be seen in FIG. 3 and the thread configuration is referred to as having 2-step thread flanks. This thread configuration has great strength and, being cut on two different diameters, makes it impossible to cross thread the connection (since both threaded diameters have to be started simultaneously). The configuration provides a 30° torque shoulder and pressure seal 32 at the upper end of the joint and may optionally be provided with a circumferential relief groove and a chamfer at the apex of the shoulder providing a 14° pressure seal. The lower end 34 of the upper pipe section is chamfered at 14° to cooperate with a mating surface on the next lower pipe section to provide a pressure seal. The purpose of these seals will be discussed hereinafter. At this point, it should be noted that this connection is a very high-strength connection and is pressure tight. The connection at the very top of this guide has sufficient strength to support several thousand feet of pipe. The procedure for threading the sections together is the same as used in assembling drill pipe in oil fields.

The top drill pipe section 30 is connected to a solid bar 36 which has an integral head 38 resting on the top of the clamp assembly 40 which rests on top of the deck 16. The solid bar hangs down through the deck and the top pipe section 30 is connected to the lower end of the bar 36. The purpose of this type of connection is to avoid harmful stress at the connection of the upper pipe to the suspension. Thus, there will be some movement of the bar 36 relative to the clamp 40 and the deck 16 and this sets up some stress which is confined to the bar 36 and the threaded connection of the top pipe section to the bar is well removed from the stress.

Figure 4:
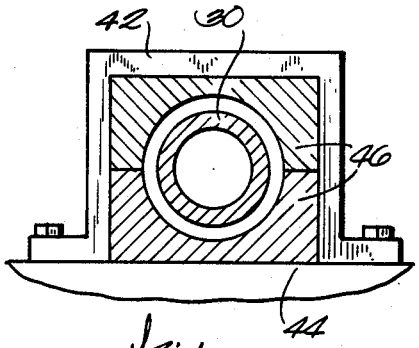
FIG. 4 is a detail of a lateral support clamp employed at the bottom of the mine shaft above the biasing weights.
Figure 1:
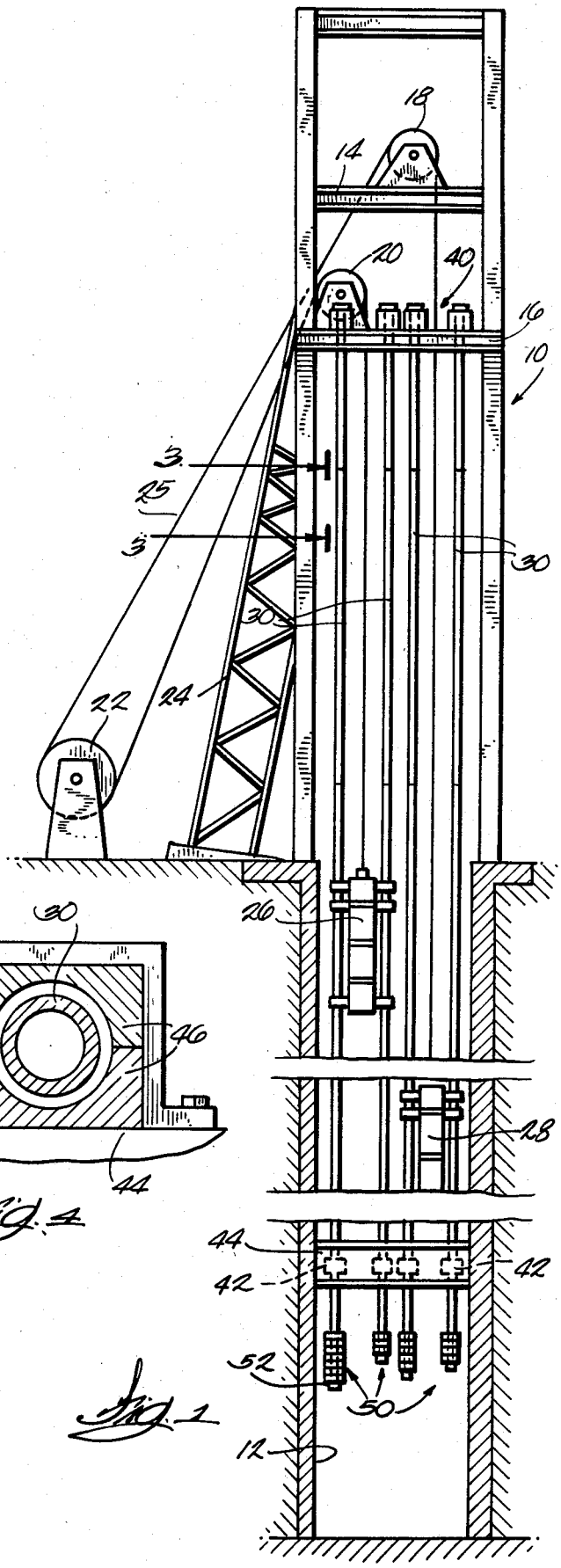
FIG. 1 is a schematic showing of a mine shaft arrangement incorporating pipe guides.

The pipe 30 hangs free for its vertical length but at the lower end, at the bottom of the shaft, the pipe passes through a lateral support housing 42 bolted to the fixed support 44 as shown in FIG. 4. The housing 42 has a two-piece bushing or liner 46 secured therein with some clearance around the drill pipe 30. This permits the drill pipe limited lateral movement and does not restrain vertical movement of the drill pipe as it expands and contracts with temperature changes. Thus, each drill pipe is guided at its lower end. The pipe extends through the clamp or housing 42 and is connected to a solid bar 48 which closes off the lower end of the hollow drill pipe and extends on down the mine shaft a short distance to carry weights 50 thereon resting on the head 52. These weights 50 are a different quantity for each drill pipe so the biasing weights are not the same. The pipes will have different harmonic movement. When the harmonics are dissimilar, they tend to cancel each other and undue stress is avoided while providing smoother travel.

In the illustrated embodiment, each of the conveyances 26 and 28 is guided by two guides, one on each side of the conveyance. The top and bottom of each side of each conveyance is provided with a pipe guide 54. Each guide has a hinge 56 permitting the outer part of the guide bracket to be pivoted away from the portion fixed to the frame 58 of the conveyance to provide access to the split lining 60, 62 for service or replacement. The lining may be metallic or nonmetallic bushing material to provide low friction with the drill pipe as the conveyance is in transit. When the bracket is closed, the bolt 64 projecting from the stationary part passes through the hinged outer plate 66 and the bracket is held in the closed position by means of nut 68.

A safety device, or safety brake, 70 is provided at the top of each side of the conveyance. This is a simple device schematically shown in the drawings. The device has a lever 72 pivoted at 74 and connected to the hoist cable 25 which is connected to a conveyance at 76. Spring 78 biases the lever in a clockwise direction. When there is tension on cable 25 and the safety brake is hooked up as illustrated, the forked end of the arm 80 connects to trunions 82 which are connected to the brake shoes 84 which normally are spaced from the drill pipe 30 as can be seen in FIG. 7. The brake shoes fit between the guide pipe 30 and the inclined guides 86 so that the guides will force the shoes 84 against the pipe upon acutation of the safety brake. If cable 25 goes slack (indicating a broken cable), spring 78 rocks lever 72 in a clockwise direction to lift the brake shoes 84, 84 between the inclined shoes and the pipe to force the shoes against the pipe. At this point the brake shoes are forced against the pipe and brake is self-actuating. The brake exerts great pressure against the pipe. This stops the conveyance and locks it on the pipe. The drill pipe can withstand this force. Oil field drill pipe is rated for internal and external working pressures in excess of 13,000 psi. Thus, the pipe is able to withstand considerable crushing force with no adverse effect. The pipe will not be damaged with a single actuation as can occur with rope guides.

The bar 48 connected to the lower end of the drill pipe guide 30 is solid. The bar 36 at the upper end is essentially solid but has a small bore fill conduit 88 wih a "T" connection at the upper end. One side of the "T" goes to a valve V which can be opened to fill the drill pipe with an inert gas such as nitrogen to expel any corrosive atmosphere. Preferrably the pipe is filled to a pressure above atmospheric (a bleed can be provided at either end of the pipe, probably the lower end, for exhausting the air as the pipe is filled). The other side of the "T" at the top of the fill conduit 88 is provided with a pressure switch schematically shown in the drawings. This pressure switch is normally held open when the pressure in the interior of the guide pipe is above the desired pressure. If a leak should develop, the pressure switch 90 would close a circuit including the alarm A to sound the alarm to draw attention to the fact there is a leak in the system (which would normally indicate there is a crack in the pipe or some other problem). Thus, this assembly becomes self-inspecting and the inspection costs normally associated with a guide system are greatly reduced.

I claim:

1. In combination with a mine shaft arrangement for an underground mine having a headframe above the surface at the shaft opening, a guide system comprising, a plurality of tubular pipe guides in said shaft, each guide comprising a multiplicity of pipes threaded one to another to provide a smooth exterior surface at each threaded joint and depending below the normal range of conveyance travel in the shaft, means suspending each guide from the headframe, said means including a substantially solid bar depending from said headframe and threadably connected to the uppermost pipe, a bushing positioning each pipe guide relative to the shaft, each bushing being fixed in the shaft below said range with the associated pipe guide passing loosely therethrough to permit vertical movement of the pipe guide relative to the bushing, a conveyance suspended from the headframe and guided by the pipe guides, said conveyance having guide bushings slideably engaging each of the pipe guides.

2. The combination of claim 1 including weights attached to the bottom of each of said pipe guides, the total weight added to each of the guides being unequal to that added to any of the other guides to avoid setting up similar harmonics in the various pipe guides.

3. The combination according to claim 2 including a substantially solid bar threaded into the lower end of each of the pipe guides, said weights being attached to said bar at a point spaced from the threaded connection between the guide and the end of the bar.

4. The combination according to claim 3 in which all of said threaded connections are pressure tight and the interior of each pipe guide is maintained at a pressure above atmospheric pressure, and means for monitoring said pressure and responsive to a predetermined decrease in pressure to activate an alarm signal.

5. The combination according to claim 4 in which the interior of each guide is provided an inert gas atmosphere.

6. The combination according to claim 5 including a safety mechanism attached to said conveyance at each pipe guide, said safety mechanism including a safety device operative to clamp the pipe guide in response to a slack hoist rope.

* * * * *